United States Patent [19]

Fujimoto et al.

[11] Patent Number: 4,688,392

[45] Date of Patent: Aug. 25, 1987

[54] REFRIGERATION UNIT INCLUDING A HOT GAS DEFROSTING SYSTEM

[75] Inventors: Yuji Fujimoto, Osaka; Masayuki Aono, Sakai; Tsutomu Takei, Tondabayashi; Tetuo Nakano, Takaishi; Teiji Nakabayashi, Kishiwada, all of Japan

[73] Assignee: Daikin Industries, Ltd., Osaka, Japan

[21] Appl. No.: 857,315

[22] Filed: Apr. 30, 1986

Related U.S. Application Data

[62] Division of Ser. No. 601,014, Apr. 16, 1984, Pat. No. 4,602,485.

[30] Foreign Application Priority Data

Apr. 23, 1983 [JP] Japan ..... 58-71770
Apr. 23, 1983 [JP] Japan ..... 58-71771
Apr. 23, 1983 [JP] Japan ..... 58-71773

[51] Int. Cl.[4] ..... F25B 41/00; F25D 21/06

[52] U.S. Cl. ..... 62/174; 62/151; 62/278

[58] Field of Search ..... 62/174, 81, 277, 278, 62/196.4, 151

[56] References Cited

U.S. PATENT DOCUMENTS

| | | | |
|---|---|---|---|
| 2,451,682 | 10/1948 | Lund | 62/278 X |
| 2,718,120 | 9/1955 | Wiley | 62/278 |
| 2,724,245 | 11/1955 | Swinburne | 62/278 |
| 3,332,251 | 7/1967 | Watkins | 62/81 |
| 3,633,378 | 1/1972 | Toth | 62/278 X |
| 3,692,100 | 9/1972 | Gallagher, Jr. | 62/323 |
| 4,009,594 | 3/1977 | Swanson | 62/278 |
| 4,193,781 | 3/1980 | Vogel et al. | 62/81 |
| 4,353,221 | 10/1982 | Taylor | 62/239 |
| 4,356,703 | 11/1982 | Vogel | 62/155 |

*Primary Examiner*—Harry B. Tanner
*Attorney, Agent, or Firm*—Stevens, Davis, Miller & Mosher

[57] ABSTRACT

A refrigeration unit comprising a cooling circuit having a compressor, a condenser and an evaporator, and said unit including a hot gas valve and a hot gas bypass passage bypassing the condenser and forming a defrost circuit, so that when the evaporator is frosted upon operation by means of the cooling circuit, constant quantity refrigerant is circulated around the defrost circuit to perform a defrosting operation.

5 Claims, 13 Drawing Figures

REFRIGERATION UNIT INCLUDING A HOT GAS DEFROSTING SYSTEM

This is a division of application Ser. No. 601,014, filed Apr. 16, 1984 U.S. Pat. No. 4,602,485.

FIELD OF THE INVENTION

This invention relates to a refrigeration unit or more particularly to a refrigeration unit having a compressor, condensers and an evaporator and capable of performing a selection between three operation, i.e., a cold storage, and/or a refrigeration, and a defrosting operation. The terminology is defined as that the "cold storage" operation is a control for any temperatures higher than −5° C.−−6° C., and the "refrigeration" operation is a control for any lower temperatures lower than −5° C.−−6° C.

BACKGROUND OF THE INVENTION

A system which performs defrosting by introducing hot gas into an evaporator at the defrost time is previously known as shown in the specification and drawings of U.S. Pat. No. 4,353,221. To explain this conventional system in FIG. 12, a three-way valve TV is provided on the high pressure gas line B of a compressor A, one outlet of said three-way valve being connected to a condenser C and the other outlet to a hot gas by-pass passage H bypassing said condenser C, receiver R and expansion valve EV, said hot gas by-pass H being connected to the inlet side of said evaporator E, said hot gas by-pass passage H being provided with a pressure regulating valve $V_1$ which throttles its opening by sensing the pressure rise at the outlet side of said evaporator E, a pressure regulating valve $V_2$ which opens by sensing the increase in high side pressure being provided between said hot gas bypass passage H and said condenser C. In the defrosting operation, said three-way valve TV is switched on to the hot gas bypass passage H to use hot gas in said evaporator E for defrosting and said two pressure regulating valves $V_1$, $V_2$ control their respective openings so that neither suction pressure nor discharge pressure does not rise abnormally.

With this conventional system, however, in case of overloaded defrosting operation, though ot gas quantity passed through the hot gas bypass passage H to the evaporator is controlled by said pressure regulating valves $V_1$, $V_2$, the surplus hot gas is bypassed, through said pressure regulating valve $V_2$, into the condenser C and the receiver R and in liquid form, flows into said evaporator E together with said hot gas. In other words, with this system, the refrigerant quantity charged into the system circulates at the defrosting operation and the defrosting heat amount of hot gas is reduced by the amount corresponding to the refrigerant quantity bypassed to the condenser C. In spite of no decrease in the compressor A input, defrosting heat amount is decreased, which results in that much costly and inefficient defrosting operation.

Conventionally, a refrigeration system which has a hot gas bypass passage to supply hot gas discharged from the compressor to an evaporator, bypassing a condenser and controls its capacity for holding the hold temperature in the chilled range by adjusting hot gas quantity bypassed to said evaporator has been disclosed, for example, as shown in the specification and drawings of U.S. Pat. No. 3,692,100.

To explain the outline of this conventional system in accordance with schematic drawing, FIG. 13, a hot gas bypass passage is connected to the high pressure gas line which connects the discharge side of a compressor A with the inlet side of condensers $C_1$,$C_2$ so as to bypass said condensers $C_1$,$C_2$, a receiver R and expansion valve EV, said hot gas bypass line H being connected to the inlet side of the evaporator, said hot gas bypass line H being provided, near at its connection to said high pressure gas line B, with a hot gas valve HV which controls hot gas bypass quantity to said evaporator E, the capacity of said evaporator E being controlled by adjustment of said hot gas valve HV so as to control the supply air temperature consequently, the hold temperature in the chilled range.

By the way, with the conventional system when said evaporator E is fronsted, the defrosting operation performed by circulating hot gas through said evaporator E may be adopted and performed. Generally in case of cold storage operation for controlling the hold temperature in the chilled range, the low side pressure of refrigerant becomes high and the refrigerant circulation quantity becomes that much larger and on the other hand, in case of refrigeration operation for controlling the hold temperature in the refrigeration range, the low side refrigerant pressure becomes lower and the refrigerant circulation quantity becomes small. For this reason, in case of defrosting operation by hot gas, the refrigerant circulation quantity around the defrosting circuit varies with the operating condition immediately before entering defrosting operation, which results in the following problems.

That is, when the defrosting operation is entered from a cold storage operation condition wherein the low side pressure of refrigerant is high and refrigerant circulation quantity is large, it is possible to complete defrosting in a short time because of large refrigerant circulation around the defrosting circuit, but on the other hand, because of high air temperature around said evaporator E, refrigerant pressure becomes abnormally high when returning to the cold storage operation and overloads the compressor motor, which results in bringing the system beyond the operation range and the failure to run the system by the operation of the high pressure switch and the over-current relay. Further, when the defrosting operation is entered from a refrigeration operation condition wherein the low side pressure is low and refrigerant circulation quantity is small, it takes long to complete defrosting because of small refrigerant circulation around the defrosting circuit.

As stated above, when conducting defrosting by passing hot gas through the evaporator E, the hot gas circulation quantity through said evaporator E varies with the operating condition immediately before said defrosting, which makes an appropriate defrosting operation impossible.

SUMMARY OF THE INVENTION

The purpose of this invention is to optimize, at the defrosting operation, the refrigerant circulation quantity around the defrosting circuit so as to provide appropriate defrosting and ensure said appropriate defrosting irrespective of the operating condition immediately before said defrosting operation.

Like above stated examples of the conventional system, in a refrigeration unit having a compressor, condensers and an evaporator and capable of performing a selection between three operation, i.e., a cold storage, and/or a refrigeration, and a defrosting operation, or a selection of one of the cold storage and the refrigeration, and the defrosting operation; or one of the cold storage and the defrosting operation; or one of the refrigeration and the defrosting operation, this invention comprises and is characterized by a cooling circuit which returns hot gas discharged from the compressor through the condensers and the evaporator back to the compressor; a hot gas bypass passage which supplies hot gas to said evaporator, by passing said condensers; a hot gas valve which opens and closes said hot gas bypass passage; a defrost circuit which supplies hot gas from said hot gas bypass passage to said evaporator by means of said hot gas valve and returns it to the compressor; a first stop valve which is provided downstream of said condensers in said cooling circuit and closes for the pumping-down operation at the start signal of defrosting operation and seals refrigerant in said cooling circuit including said condensers by said pumping-down operation; and a constant refrigerant quantity control mechanism which supplies certain refrigerant quantity necessary for the defrosting operation out of refrigerant quantity stored in the liquid reservoir in said cooling circuit to said defrosting circuit for the defrosting operation.

Further, with respect to said constant refrigerant quantity control mechanism which circulates constant refrigerant quantity around the defrosting circuit in the defrosting operation, the following type of mechanism are to be considered.

(1) a mechanism wherein a second stop valve is employed to seal in predetermined constant quantity refrigerant between this valve and said first stop valve and said constant quantity refrigerant is supplied to the defrost circuit by opening said first stop valve after the completion ofthe pumping-down operation.

(2) a mechanism wherein a communication passage is provided to communicate the high pressure side, downstream of the condenser, with the suction side of the compressor and a third stop valve is provided on said communication passage and constant quantity refrigerant out of refrigerant quantity stored in said liquid reservoir is supplied to the defrost circuit by opening said third stop valve.

(3) a mechanism whereby the pumping-down operation is run so as to leave constant quantity refrigerant in the defrost circuit at the completion of the pumping-down operation.

In any cases, the refrigerant unit is run, at the defrosting operation, so as to circulate constant quantity refrigerant around the defrost circuit and thereby is able to perform the optimum defrosting operation irrespective of the operating condition immediately before entering the defrosting operation. Further, with respect to the detail of said constant quantity refrigerant control mechanism , the explanation will be given in the detailed description of preffered embodiments in accordance with drawings.

DETAILED DESCRIPTION OF PREFERED EMBODIMENTS OF THE INVENTION

Figure 1:
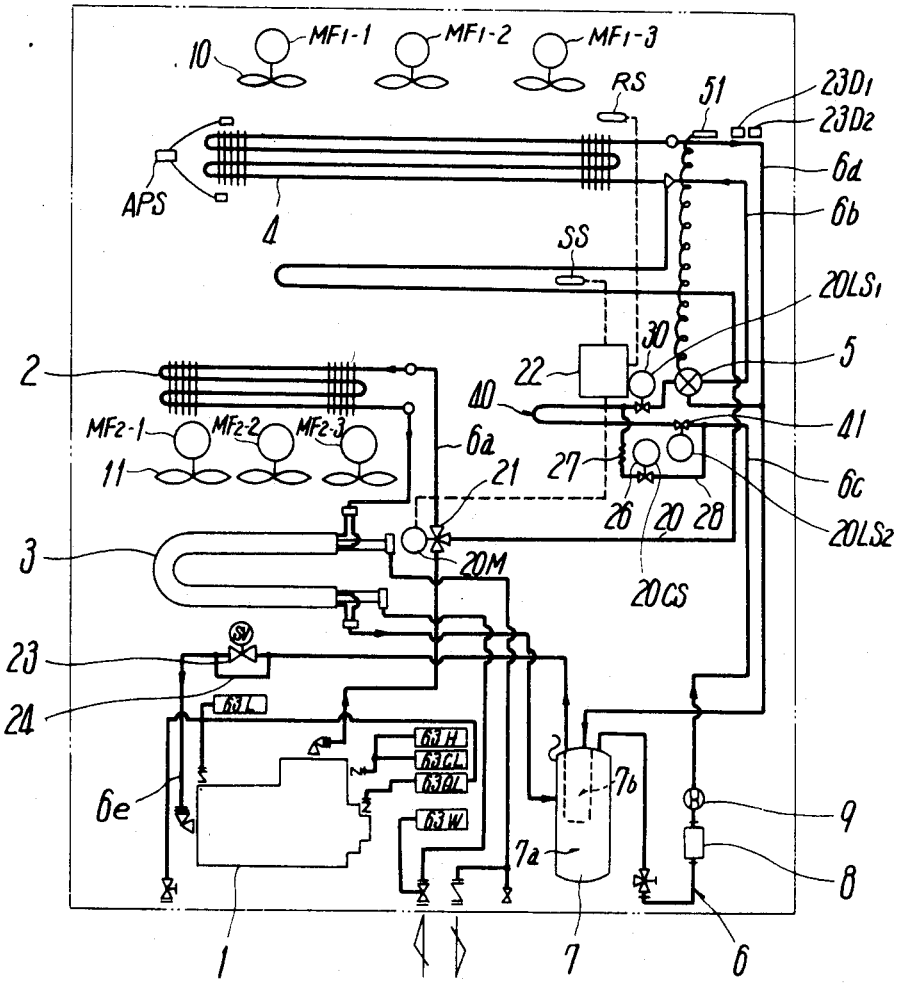
FIG. 1 is the refrigerant piping diagram showing No. 1 embodiment of the refrigerant unit of this invention.

Shown in FIG. 1 is a typical embodiment of the refrigeration unit of the invention for the marine container application. In FIG. 1, numeral 1 is a compressor, numeral 2 an air-cooled condenser, numeral 3 a water-cooled condenser, numeral 4 an evaporator, numeral 5 a thermostatic expansion valve with a feeler bulb 51 and each of these components is connected by the piping 6 to constitute a cooling circuit which cools the hold air by said evaporator 4.

Further, in FIG. 1, numeral 7 is a receiver integrated with an accumulator, numeral *7a* the receiver portion thereof, numeral *7b* the accumulator portion thereof, numeral 8 a drier, numeral 9 a liquid indicator, numeral 10 refers to the fans mounted on said evaporator 4 and numeral 11 the fans attached to said air-cooled condenser 2.

Further, in the above-described refrigeration circuit, a hot gas bypass passage 20 is connected to the high pressure gas line *6a* connecting the delivery side of said compressor 1 to the inlet side of said air-cooled condenser so as to supply hot gas discharged from the compressor 1 directly to said evaporator 4, bypassing said condensers 2, 3, the receiver portion *7a* of said receiver 7 and said thermostatic expansion valve 5. The outlet side of said hot gas bypass passage 20 is connected to the low pressure liquid line *6b* between said expansion valve 5 and said evaporator 4. Hot gas valve 21 being provided on the junction part of this hot gas bypass passage 20 with said high pressure gas line *6a* to control hot gas bypass flow and adjust the capacity in the cold storage operation. The entire hot gas volume bypassed through said hot gas valve 21 is supplied through said hot gas bypass passage 20 to said evaporator 4 to form the defrost circuit.

Further, the embodiment in FIG. 1 is provided, downstream of said liquid indicator 9 with a first stop valve 30, which is a solenoid type value which closes at the stop signal of the refrigeration operation or the cold storage operation and the start signal of the defrosting operation in order to enable the pumping-down operation and seal refrigerant in the liquid reservoir portion including said condenser, 2, 3, the receiver portion *7a* of the receiver 7.

Further, a constant quantity refrigerant flow-out control mechanism 40 is provided to supply a constant quantity of refrigerant out of the entire refrigerant thus sealed in said liquid reservoir into the defrost circuit for the defrosting operation, that is, said defrost circuit comprising the compressor 1, the hot gas valve 21, the hot gas bypass passage 20, the evaporator 4 and the accumulator portion 7*b* of the receiver 7.

Said hot gas valve 21 is primarily a motorized three-way type proportional control valve capable of controlling its opening, from 0 to 100%, to said hot gas bypass passage 20 in proportion with to the voltage applied thereto and is constructed so as to adjust the capacity by controlling hot gas volume bypassed to said evaporator 4 and to supply the entire refrigerant volume in circulation at defrosting to said hot gas passage 20. Hot gas valve 21 is controlled by controller 22, described in detail below and the auxiliary switch $2DX_2$ of the defrost control circuit. Further, said hot gas valve 21 is PID controlled by the controller 22.

This PID control (proportional-plus-integral-plus-derivative control) constitutes a control wherein the control signal is proportional with the sum of deviation signal, its integral and its deviative.

Furthermore, said constant quantity refrigerant flow-out control mechanism 40 is constructed to mount a second stop valve 41, also of solenoid type, in the liquid reservoir portion, for the pumping-down operation by closing said first stop valve 30, so as to seal constant quantity liquid between the mounting position of said first stop valve 30. In FIG. 1, said first stop valve 30 is mounted on the high pressure liquid line 6*c* at the inlet side of said expansion valve 5 and said second stop valve 41 on the high pressure liquid line 6*c* at the outlet side of said liquid indicator 9 so as to seal constant quantity refrigerant in the high pressure liquid line 6*C* between the two valves 30, 41 and pass thereof to the evaporator 4 by opening said first stop valve 30 with said second stop valve 41 left closed.

Said constant quantity of refrigerant set by said constant quantity refrigerant flow-out control mechanism 40 is to be set at the optimum so that the refrigeration operation or cold storage operation which follows the defrosting operation is always operable irrespective of the operating condition, and the defrosting operation does not take long.

While said constant quantity refrigerant flow-out control mechanism 40 is constructed by the high pressure liquid line 6*c*, said second stop valve 41 and said first stop valve 30, it may be constructed in the low pressure liquid line 6*b*, only if it is located downstream of condensers 2, 3, that is, downstream of the liquid reservoir. Further, said constant quantity refrigerant flow-out control mechanism 40 may be constructed by using a special piping or liquid reservoir in place of the refrigerant circuit liquid line.

Further in FIG. 1, a bypass passage 28 having a solenoid valve 26 and in-series connected capillary tube 27 is provided between the high pressure liquid line 6*c* at the inlet side of said second stop valve 41 and the high pressure liquid line 6*c* at the inlet side of said first stop valve 30, thus by passing said second stop valve 41.

The purpose of providing this bypass passage 28 is, as later described, so that it can be used in the cold storage operation when necessary. Further, since the outlet volume of said solenoid valve 26 at the bypass passage 28 is so small, it is negligible to said constant quantity refrigerant .

Further in FIG. 1, numeral 23 is a solenoid valve mounted on the suction gas line 6*e* which closes when energized and is arranged in parallel with a capilary tube 24.

The purpose of this solenoid valve 23 is to return gaseous refrigerant to the compressor 1 through said capilary tube 24 by the close thereof and thereby reduce the refrigerant circulation quantity. Said reduction of refrigerant circulation quantity is for the purpose of protecting overloading due to the high temperature of the high pressure side which takes place, in the event of a high ambient temperature, in the refirgeration or cold storage operation after defrosting operation or at the pull-down operation, and due to said reduction of refrigerant circulation the work of the compressor 1 is reduced and the high side pressure and the compressor motor current is lowered, thereby enabling the expansion of the operation range.

Further, while said solenoid valve 23 is arranged so as to close when the suction air temperature of the evaporator 4 is sensed by a sensor to have exceeded a certain temperature and open when said suction air temperature is sensed by a sensor to have fallen below said temperature, it may be controlled by the high side pressure or the low side pressure. It may be controlled also by the suction air temperature of the air-cooled condenser 2, that is, the ambient air temperature so as to close above a certain temperatures thereof and open below said temperature.

Further in FIG. 1, numeral 63L is a low pressure switch, numeral 63H a high pressure switch, numeral 63CL a high pressure control switch, numeral 63QL an oil pressure protection switch and numeral 63W a water pressure switch.

Further in the above construction, said hot gas valve 21 is arranged, as described below in connection with FIG. 2, to be controlled by the output signal of said controller 22 and the start signal of the defrosting operation and said first stop valve 30 is closed for the pumping-down operation at the start signal of the defrosting operation. Further, the completion of the pumping-down operation and the start of the defrosting operation is controlled primarily by the low-pressure switch 63L.

Further, for the start of said defrosting operation, the air pressure switch APS which senses the pressure drop across said evaporator 4 and a defrost timer 2D which sets the defrosting time for example at 12 hours are in use. In this case, said air pressure switch APS is given priority over said defrost timer 2D and by the operation of said air pressure switch APS, said defrost timer 2D is reset.

Further, the defrosting operation is completed by sensing the temperature of said low pressure gas line 6*d* by means of two thermostats $23D_1$, $23D_2$ having different set temperature which are mounted on the low pressure gas line 6*d*, for example, at the evaporator 4 outlet.

Figure 2:
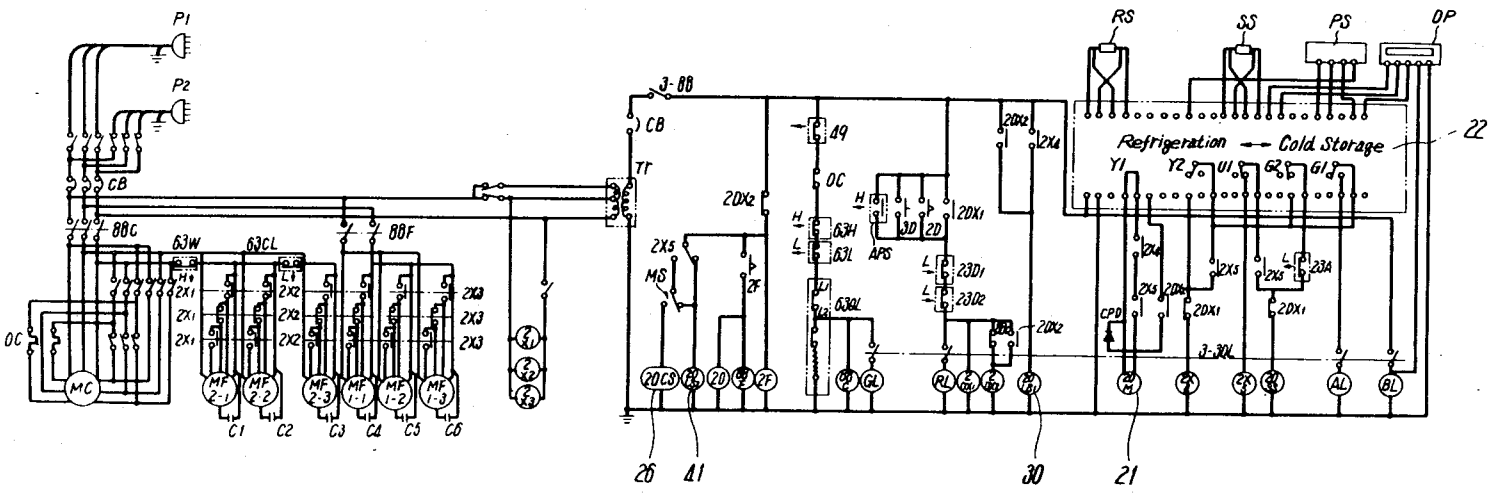
FIG. 2 is the wiring diagram thereof and FIG. 3 is the flow chart for the defrosting operation thereof.

Next, the wiring circuit for the controller 22 to control the suction air temperature or the supply air temperature by controlling hot gas valve 21 and for various controllers to control the defrosting operation is described in accordance with FIG. 2.

Shown in FIG. 2 is a wiring diagram of the refrigeration unit as shown in FIG. 1, wherein the compressor motor MC, three indoor fan motors $MF_{1-1}$, $MF_{1-2}$,$MF_{1-3}$ corresponding to three fans 10 attached to said evaporator 4 and three out-door fan motors $MF_{2-1}$, $MF_{2-2}$, $MF_{2-3}$ corresponding to three fans 11 attached to said air-cooled condenser 2 are provided, the electric circuit of said electric machinery being connected to the power source by selecting either the low tension plug $P_1$ for 200 V/220 V or the high tension plug $P_2$ for 380–415

V/440 V and the control circuit of said controller 22 and various controls being connected, through a transformer Tr to said electric circuit.

Further in FIG. 2, CB is a circuit breaker, OC an over-current relay, $2X_1$–$2X_3$ auxiliary relays and their contacts, 3-88 an on-off switch. Further, contacts having no reference symbols are the contacts that are switched over by the selection of said plug $P_1$ or $P_2$, $Y_1$, $V_1$, $G_2$ and $G_1$ are the change-over switch between the refrigeration operation and the cold storage operation noused in said controller 22, $Y_1$ being a short-circuit line.

Further, said controller 22, though not shown in FIG. 2, is provided with an input transformer, a power input unit, a sensor input unit, an operation input and output unit, a central processing unit and a relay output unit. And connected to said sensor input unit are, as shown in FIG. 1, the return sensor RS located on the suction side of the evaporator 4 for sensing the return air temperature from the hold and the supply air sensor SS located on the supply side of the evaporator 4 for sensing the supply air temperature to the hold. Connected to said operation input and output unit are a set point selector PS and an output display unit DP and connected to said relay out-put unit are the motorized portion 20M of said hot gas valve 21, the solenoid relay 20SS of said solenoid valve 23 of the embodiment of FIG. 1, auxiliary relays $2X_4$, $2X_5$, lamps AL, BL and the following relay circuit:

(1) A circuit in-series consisting of a parallel circuit of normally-open contacts of auxiliary relays $2X_4$, $2DX_2$, and the solenoid relay $20LS_1$ of said first stop valve 30 for the pumping-down operation (pumping-down control circuit).

(2) Acircuit in-series connected consisting of a parallel circuit of the contacts of the air pressure switch APS for signaling the start of the defrosting operation, the defrost timer 2D, the manual defrost switch 3D and the normally-open contacts of the defrost relay $2DX_1$; the in-series circuit of two thermostat $23D_1$, $23D_2$ for detecting the completion of the defrosting operation; a parallel circuit of said defrost relay $2DX_1$ and a parallel circuit of the normally-closed contacts of the magnet switch **88*c*** of the compressor motor MC and the self-holding contacts of the auxiliary relay $2DX_2$ with the auxiliary relay $2DX_2$ in-series connected (defrost control circuit).

(3) An in-series connected circuit consisting of a compressor protection thermostat 49, an over-current relay OC, a high pressure switch 63H, a low pressure switch 63L, an oil pressure protection switch 63QL and the magnet switch **88*c*** of the compressor motor (on-off control circuit of the compressor motor MC)

(4) An in-series connected circuit consisting of the normally closed contacts of the auxiliary relay $2DX_2$ and a parallel circuit consisting of the circuit of the delay timer 2F of the indoor fan motors $MF_{1-1}$, $MF_{1-2}$,$MF_{1-3}$ attached to the evaporator 4, a circuit of the contacts of said delay timer 2F with a parallel circuit of the magnet switch 88F of said indoor fan motors $MF_{1-1}$, $MF_{1-2}$,$MF_{1-3}$ and said defrost timer 2D in-series connected, and an in-series connected circuit consisting of the switch-over contacts of the auxiliary relay $2X_5$ and the manual change-over switch with one terminal connected to the solenoid relay $20LS_2$ of said second stop valve 41 and with the other terminal connected to the solenoid relay 20CS of said solenoid valve 26 (primarily for constant quantity refrigerant flow-out control).

Further in FIG. 2, CPD is a contact protection diode, GL and RL lamps and 3-30L a lamp switch.

Further, the motorized portion 20M of said hot gas valve 21 is arranged to be switched over to be 100% open position by means of a direct circuit through the normally-open contacts of said auxiliary relay $2DX_2$ which is provided separately of the control circuit of said controller 22.

In the above described construction, the control of the hold air temperature is performed, based on the set temperature of the point selector PS of said controller 22 by on-off control of the compressor 1 at the signal of the retrun sensor RS in case of the refrigeration operation of below −5° C. set temperature and by controlling said hot gas valve 21 between 0–100% and bypassing the hot gas quantity corresponding to the respective opening at the signal of the supply air sensor SS in case of the cold storage operation of above −5° C. set temperature. Further in this case, it is also possible to conduct the cold storage operation using the bypass passage 28 by switching the manual change -overswitch MS so as to close the second stop valve 41 and open the solenoid valve 26.

Figure 3:
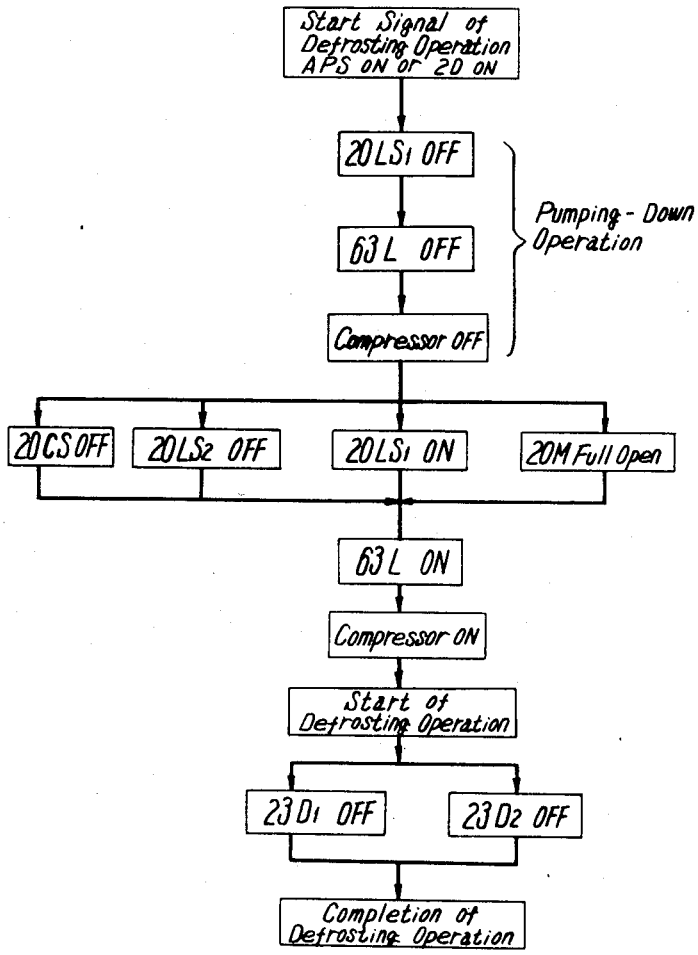

By the way, during the refrigeration or cold storage operation when frost accumulates on the evaporator 4 and he start signal of the defrosting operation is issued by the operation of the air pressure switch APS or the defrost timer 2D, the defrosting operation is conducted as follows:

This defrosting operation will be explained in accordance with the flow chart shown in FIG. 3.

When the start signal of the defrosting operation is issued as stated above, the defrost relay $2DX_1$ is energized and said auxiliary relay $2X_4$ deenergized to open said pumping-down control circuit and deenergize the solenoid relay $20LS_1$ of said first stop valve 30 and close said first stop valve 30 for starting the pumping-down operation.

In the pumping-down operation, liquid refrigerant is sealed in the condensers 2, 3, the receiver portion **7*a* of the receiver 7 and the liquid line 6C extending to said first stop valve 30 and at the same time the low side pressure of the compressor 1 become lowered. When the low side pressure falls below the set value of said low pressure switch 63L, said low pressure switch 63L opens said on-off control circuit of the compressor motor MC and denergize the magnet switch 88*c* of said motor MC to stop the compressor 1** and complete the pumping-down operation.

Since the normally-closed contacts of said magnet switch 88C is closed by deenergization thereof, the auxiliary relay $2DX_2$ in said defrost control circuit is energized, normally-open contacts thereof being closed and self-held, the motorized portion 20M of said hot gas valve 21 being fully opened to the hot gas bypass passage 20 and the indoor fan motors $MF_{1-1}$, $MF_{1-2}$, $MF_{1-3}$ being stopped. At the same time, the normally-cloed contacts of said relay $2DX_2$ which is in-series connected with solenoid relays $20LS_2$, 20CS of said second stop valve 41 and said solenoid valve 26 which constitute said constant quantity refrigerant flow-out control mechanism 40 is opened, thereby said constant quantity refrigerant flow-out control circut being opened to deenergize said solenoid relays $20LS_2$, 20CS and close said second stop valve 41 and solenoid valve 26. Furhter, the normally-open contacts of the auxiliary relay $2DX_2$ of said pumping-down control circuit is closed, thereby the pumping-down control circuit being closed to energize the solenoid relay $20LS_1$ of said first stop valve 30 and open said first stop valve 30.

When said second stop valve 41 and solenoid valve 26 is closed and said first stop valve 30 is opened, the constant quantity liquid refrigerant sealed in the high pressure liquid line 6C between the first stop valve 30 and the second stop valve 41 or the solenoid valve 26 flows into the evaporator 4, evaporating due to the pressure difference between the high pressure and low pressure side. The reason why said liquid refrigerant evaporates and flows into the defrost circuit, that is, the evaporator 4 side is as follows:

(1) The volume of said defrost circuit is far larger than that of liquid refrigerant stored by said constant quantity refrigerant flow-out control mechanism.

(2) Since refrigerant at the outlet side of the evaporator 4 remains superheated by the pumping-down operation, the expansion valve 5 is open.

(3) Immediately after the opening of the first stop valve 30, refrigerant boils due to the pressure drop and flows into the evaporator 4 in a mixed state of liquid and gas.

(4) Even if a portion of liquid refrigerant remains, since liquid refrigerant quantity stored by said constant quantity refrigerant flow-out control mechanism is small, it can be completely evaporated by the heat capacity of the high side liquid line **6*c*** itself and heat absorbed by said high side liquid line from the ambient air.

When the low side pressure rises, by this flow-out, above the set pressure of said low pressure switch 63L, said low pressure switch 63L goes on to start the compressor 1, said constant quantity refrigerant being circulated around the defrosting circuit and the defrosting operation being performed by hot gas flowing into the evaporator 4 through said hot gas bypass passage 20.

Since this defrosting operation is performed by using constant quantity refrigerant set by said constant quantity refrigerant flow-out control mechanism 40, it is possible to perform an optimum defrosting operation irrespective of the operating condition immediately before defrosting.

During the defrosting operation, even when some refrigerant condenses in the evaporator 4, no liquid slugging takes place in the compressor 1 because liquid and gaseous refrigerant is separated in the accumulator portion **7*b***.

Further, when the defrosting operation is completed, the thermostat $23D_1$ whose setting temperature is lower of the two thermostats $23D_1$, $23D_2$ mounted on the outlet side of the evaporator 4 operates, said defrost control circuit being opened, said defrost relay $2DX_1$ being deenergized, the self-holding of the auxiliary relay $2DX_2$ being released, said solenoid relays $20LS_1$, $20LS_2$ being energized, said first stop valve 30 and second stop valve 41 or solenoid valve 26 being opened and the refrigeration unit returning to the refrigeration operation or the cold storage operation using opening control of the hot gas valve 21 by the controller 22. In case of the cold storage operation, when said manual changeover switch MS is closed on the solenoid relay 20CS side, said second stop valve 41 remains closed and only solenoid valve 26 opens.

Further, when returning to the refrigeration or cold storage operation after the completion of the defrosting operation, though the ambient temperature around the evaporator 4 is high, the operation of the high pressure switch 63H or over-current relay OC due to abnormally high pressure does not take place because of the constant quantity refrigerant control at the defrosting operation. But, in case of an abnormally high ambient temperature, an abnormal high pressure may take place in spite of said constant quantity refrigerant control. This case can be overcome by reducing the setting of said constant quantity refrigerant. Such case being rare, the embodiment in FIG. 1 is constructed so that the suction gas line **6*e* is provided, as already described, with a parallel circuit of said solenoid valve 23 and a capillary tube, said solenoid valve 23 being closed by detecting supply air temperature, high side pressure, low side pressure or the ambient air temperature, refrigerant circulated being throttled through the capillary tube 24. Further, since the solenoid relay 20SS of said solenoid valve 23 is in-series connected with a parallel circuit of the normally-open contacts of the auxiliary relay $2X_5$ and the thermostat 23A for detecting said supply air temperature through the normally-closed contacts of said defrost relay $2DX_1$, it is possible to operate at the reduced refrigerant circulation and expand the operation range at the operating condition of abnormally high ambient temperature and high side pressure. In addition, since the refrigerant circulation is large especially in the cold storage operation, said bypass passage 28 is utilized to reduce the liquid refrigerant flow and together with said capillary tube 24**, reduce the refrigerant circulation for the expansion of the operation range.

Further, since the temperature of the evaporator 4 and the ambient temperature thereof is high at the refrigeration or cold storage operation immediately after the completion of the defrosting operation, the embodiment of FIG. 2 is constructed as follows to avoid the operation of the high pressure switch 63H and overcurrent relay OC due to the rise of the low side pressure and consequent rise of the high side pressure. That is, the magnet switch 88F of said indoor fan motors $MF_{1-1}$, $MF_{1-2}$, $MF_{1-3}$ is in-series connected, through the contacts of said delay timer 2F, with the normally-closed contacts of said auxiliary switch $2DX_2$. Therefore, even when said auxiliary relay is deenergized at the completion of the defrosting operation and the normally-closed contacts is closed, the indoor fan motors $MF_{1-1}$,$MF_{1-2}$,$MF_{1-3}$ do not start immediately but after some time when the evaporator 4 and the ambient air thereof is cooled down to some extent.

As the delaying method of said indoor fan motors $MF_{1-1}$,$MF_{1-2}$, $MF_{1-3}$, a high pressure or low pressure switch having a pressure setting other than that of said high pressure or low pressure switch 63H, 63L is conceivable besides the delay timer 2F.

Figure 4:
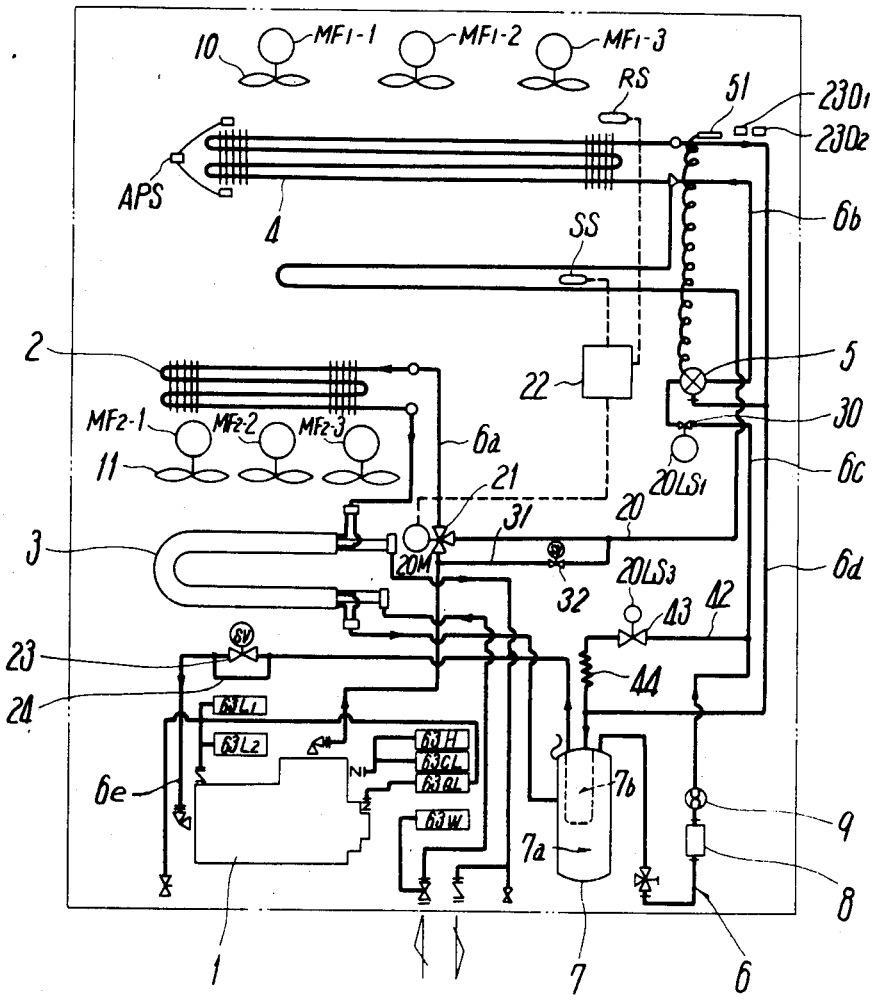
FIG. 4 is the refrigerant piping diagram showing No. 2 embodiment of the refrigeration system of this invention.

Further, said constant quantity refrigerant flow-out control mechanism 40 of the above described embodiment is constructed so that a second stop valve 41 is provided upstream of said first stop valve 30, constant quantity refrigerant sealed between these two valves 30, 41 being released to the defrost circuit by opening said first stop valve 30. However, said constant quantity refrigerant flow-out control mechanism 40 may also be constructed so that as shown in FIG. 4 a communication passage 42 is provided bypassing said first stop valve 30 so as to let the liquid reservoir in the cooling circuit communicate with the suction side of the compressor 1, said communication passage being provided with a second stop valve 43 in solenoid type which passes only constant quantity refrigerant of the refrigerant sealed in said liquid reservoir into the defrost circuit after the pumping-down operation. Further, the bypass passage 28 having a solenoid valve 26 and a capillary tube 27 of FIG. 1 is not necessary and therefor omitted in this embodiment.

Said communication passage 42 of FIG. 4 is also provided with a pressure reducing mechanism 44 primarily consisting of a capillary tube and connected, at one end thereof, to the high pressure liquid line 6*c* having said first stop valve 30 and at the other end thereof, to the low pressure gas line 6*d*.

Said first stop valve 30 may be mounted, as with the embodiment of FIG. 1, on the cooling circuit from the condenser 3 outlet to the evaporator 4 inlet, for example, on the low pressure liquid line 6*b*.

Further, said second stop valve 43 is controlled so as to open at the completion of the pumping-down operation and close after constant quantity refrigerant has been passed. The means of said control is by a low pressure switch $63L_2$ other than the low pressure switch $63L_1$ which detects the completion of the pumping-down and said switch $63L_2$ goes "on" when the low side pressure falls below the pressure setting thereof and goes "off" when the low side pressure rises above pressure setting thereof. (See FIG. 5) A timer $2D_2$ may be also used for this purpose. (See FIG. 7)

For the convenience of explanation, said low pressure switch $63L_1$ for detecting the completion of the pumping-down operation and said low pressure switch $63L_2$ are hereafter called No. 1 low pressure switch and No. 2 low pressure switch, respectively.

Said No. 2 low pressure switch $63L_2$ is mounted on the defrost control circuit described later in the wiring diagram and opens said third stop valve 43 when the compressor 1 is stopped by the off action of No. 1 low pressure switch $63L_1$ and the pumping-down operation is completed, and closes said second stop valve 43 by detecting the pressure rise due to refrigerant flow-out of said liquid reservoir. By set pressure of the off action of No. 2 low pressure switch $63L_2$, it is possible to control refrigerant quantity flowing from said communication passage to the defrost circuit.

Further, while No. 1 low pressure switch $63L_1$ also goes on by the pressure rise due to refrigerant flow-out of said communication passage 42, it is possible to start the compressor 1 simultaneously with the close of said second stop valve 43 by setting the going-on pressure thereof so as to coincide with the going-out pressure setting of No. 2 low pressure switch $63L_2$ and also start the compressor 1 steadily before the closing of said third stop valve 43 by bringing the going-on pressure setting thereof below the going-out pressure setting of No. 2 low pressure switch $63L_2$.

Further in FIG. 4, these components having no changes as compared with No. 1 embodiment are denoted by the same symbols and numeral 31 is an auxiliary bypass passage which bypasses at the cold storage operation certain quantity of hot gas irrespective of the opening of the hot gas valve 21 and improve the fluctuation of control accuracy due to the fluctuation of the opening of said hot gas valve 21 and is provided with a solenoid valve 32 which opens in the cold storage operation.

Next, the wiring diagram using No. 2 low pressure switch $63L_2$ as the on-off control means of said second stop valve 43 will be explained in accordance with FIG. 5.

Figure 5:
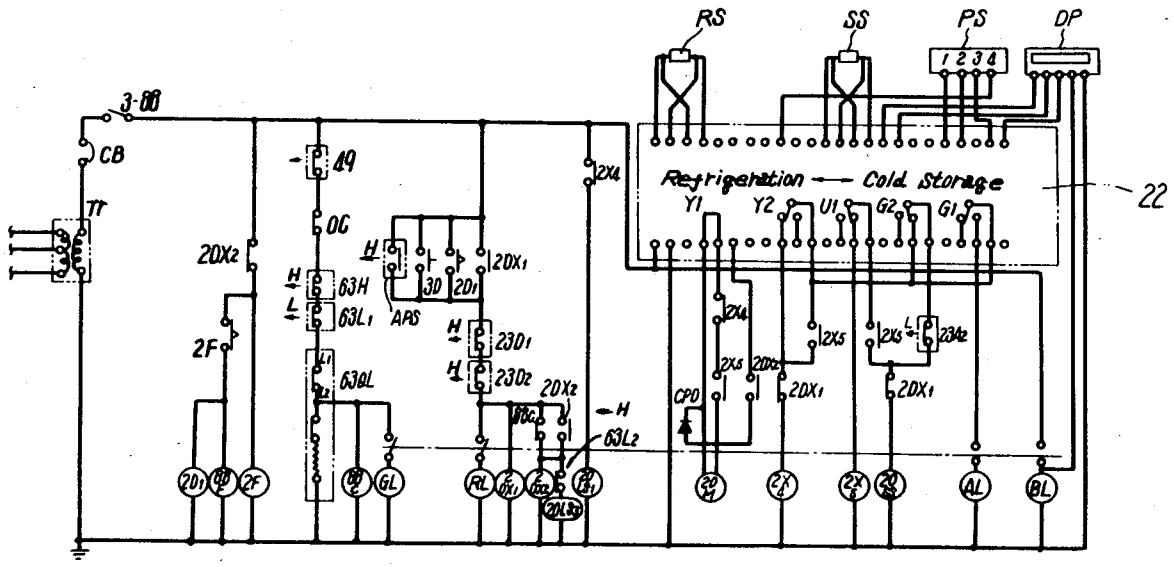
FIG. 5 is the wiring diagram thereof and FIG. 6 is the flow chart for the defrosting operation thereof.

In FIG. 5, those components having no changes as compared with FIG. 2 are denoted with the same symbols.

Since the detail has been explained in FIG. 2, only the differing points will be explained here in FIG. 5.

(1) In the pumping-down control circuit, the solenoid relay $20LS_1$ of said first stop valve 30 is in-series connected only with the normally-open contacts of the auxiliary switch $2X_4$.

(2) In the defrost control circuit, the auxiliary relay $2DX_2$ is in-parallel connected with the in-series connected circuit of the normally-closed contacts of No. 2 low pressure switch $63L_2$ and the solenoid relay of said second stop valve 43.

Further, since the solenoid valve 26 is also removed, the circuit consisting of the solenoid relay 20LS, the manual changeover switch MS and the change-over contacts of the auxiliary switch $2X_5$ is omitted.

Figure 6:
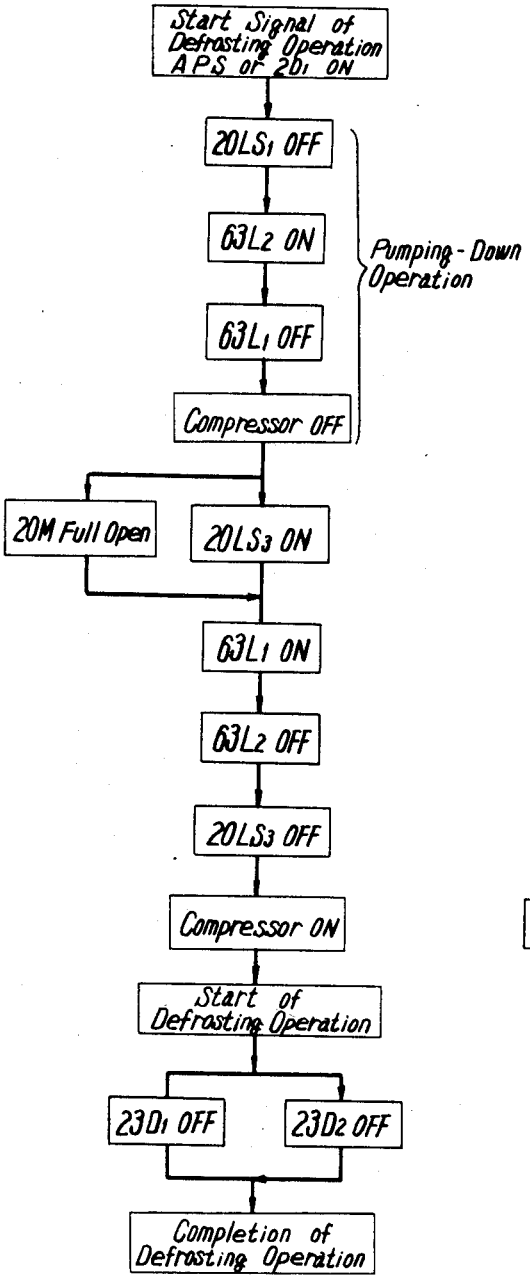

The above constructed embodiment operates just as the afore described No. 1 embodiment. As shown in the flow chart of FIG. 6, when after the start of the pumping-down operation by the defrosting signal, the compressor 1 is stopped by the operation of No.1 low pressure switch $63L_1$ to complete the pumping-down operation, the auxiliary relay $2DX_2$ is energized, the motorized portion 20M of said hot gas valve 21 is operated to fully open said hot gas valve 21, the indoor fan motors $MF_{1-1}$, $MF_{1-2}$, $MF_{1-3}$ being stopped, the solenoid relay $20LS_3$ of said second stop valve 43 being energized through No. 2 low pressure switch $63L_2$ to open said second stop valve 43, thereby refrigerant sealed at the pumping-down operation being passed, through said second stop valve 43, to the defrost circuit.

When the suction side pressure of the compressor 1 rises due to this refrigerant flow and No. 2 low pressure switch goes off, said second stop valve 43 is closed. Thereby constant quantity refrigerant is supplied into the defrost circuit.

Further, when the low side pressure rises due to this refrigerant flow, No. 1 low pressure switch $63L_1$ goes on to start, as with No. 1 embodiment, the compressor 1 and continue the defrosting operation with constant quantity refrigerant.

In the above embodiment, No. 2 low pressure switch is in use as an on-off control means for said second stop valve 43 but the timer may be used for this purpose.

Figure 8:
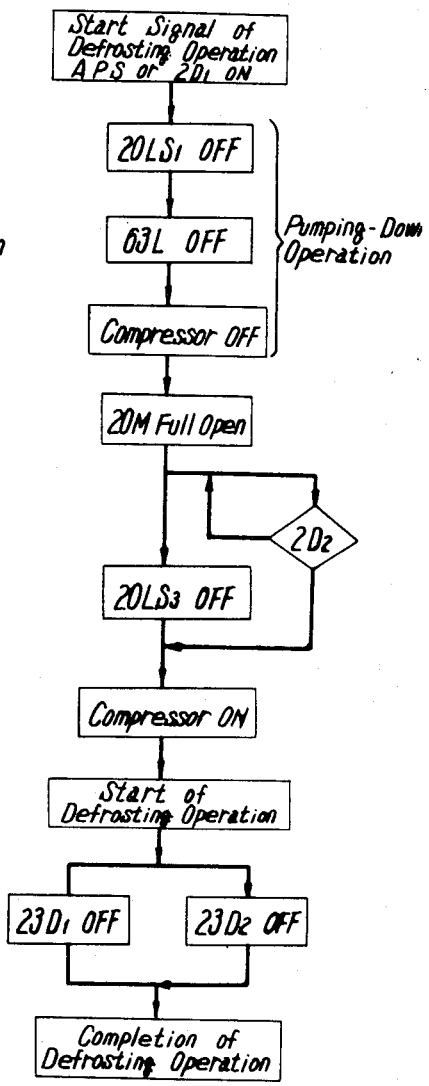
FIG. 8 is the flow chart for the defrosting operation of FIG. 7.
Figure 7:
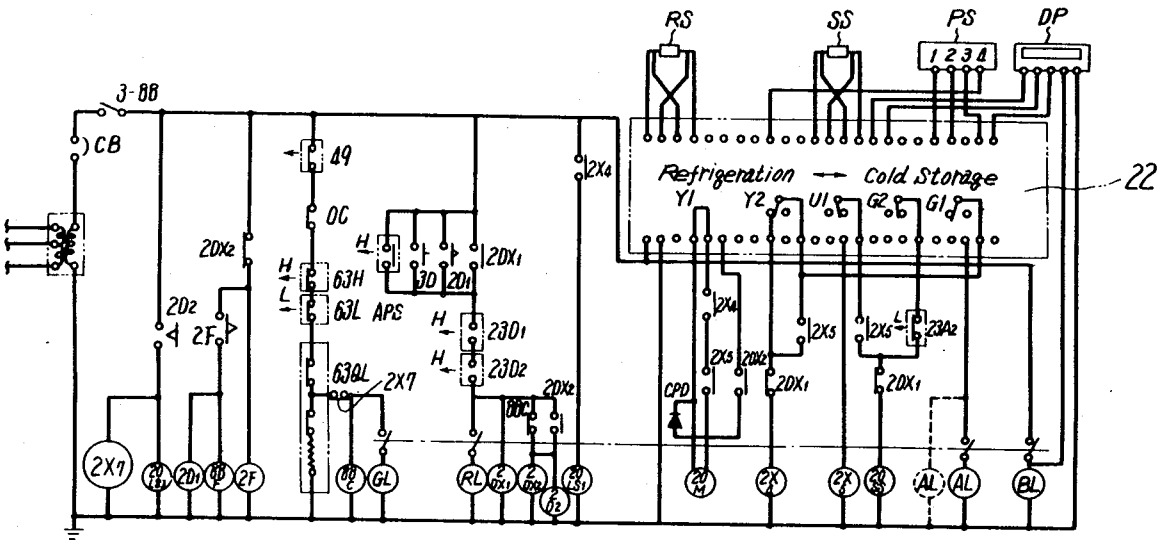
FIG. 7 is the wiring diagram of the major part of another example of No. 2 embodiment

In this case, the wiring diagram is as shown in FIG. 7 and the flow chart of the defrosting operation is as shown in FIG. 8.

That is, said timer $2D_2$ is, as shown in FIG. 7, in parallel connected with the auxiliary relay $2DX_2$ in the defrost control circuit, the timing contact of this timer $2D_2$ being in series connected with the solenoid relay $20LS_3$ of said second stop valve 43, an auxiliary relay $2X_7$ being in-parallel connected with said solenoid relay $20LS_3$, the normally-closed contact of this auxiliary relay $2X_7$ being in series connected with the magnet switch 88C in the compressor on-off control circuit of said compressor motor MC.

Further as in FIG. 8, the solenoid relay $20LS_1$ of said first stop valve 30 goes off at the start signal of the defrosting operation, to start the pumping-down operation, said magnetic switch 88C being deenergized by the off action of said low pressure switch 63L to stop the compressor 1, said auxiliary relay $2DX_2$ being energized to fully open the hot gas valve 21, the indoor fan motors $MF_{1-1}$, $MF_{1-2}$, $MF_{1-3}$ being stopped. These abovesated operation are the same as with the above described embodiment.

In this embodiment, when said auxiliary relay $2DX_2$ is energized by the deenergization of said magnet switch 88C, said timer $2D_2$ simultaneously start to work, the timing contact thereof being closed to energize the solenoid relay $20LS_3$ of said second stop valve 43 and open said third stop valve 43.

And at the expiration of the set time, for example, five minutes of said timer $2D_2$, said timer $2D_2$ finishes the work thereof, said timing contacts being opened to deenergize said solenoid relay $20LS_3$ and close said second stop valve 43.

Therefore in this embodiment, it is possible to pass constant quantity refrigerant out of the refrigerant quantity sealed at the defrosting operation by the set time of this timer $2D_2$.

Further, since the off action of the timing contacts of said timer $2D_2$ also deenergize said auxiliary relay $X_7$ to close normallyclosed contact thereof, when the low pressure switch 63L goes on due to the pressure rise by said refrigerant flow, the compressor 1 is started to start the defrosting operation.

Further, said auxiliary relay $2X_7$ is not always necessary. But by using said auxiliary relay $2X_7$, the compressor 1 is started after the counting of said timer $2D_2$ is over and said third stop valve 43 closes. Therefore, it is possible to exactly operate the flow of constant quantity refrigerant by said second stop valve 43.

Further in the above explained two embodiments, the constant quantity refrigerant control mechanism is constructed so that after the entire refrigerant is sealed in the liquid reservoir of the cooling circuit, constant quantity refrigerant is passed into the defrost circuit. This constant quantity refrigerant control mechanism, however, may be changed as follows: Though the pumping-down operation is started by the start signal of the defrosting operation, this changed version of the embodiment is constructed so that the compressor 1 is stopped to discontinue the pumping-down operation when the low side pressure has reached to a certain pressure level which is higher than the compressor 1 would reach at the completion of the normal pumping-down operation, thereby leaving constant quantity refrigerant in the defrost circuit.

Figure 10:
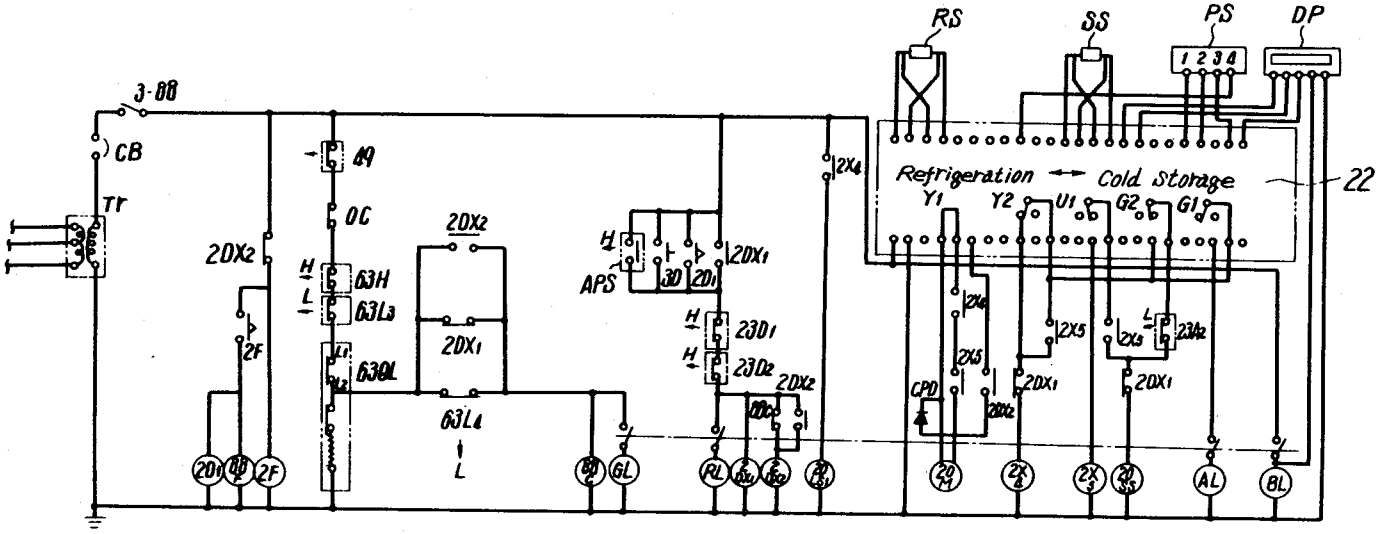
FIG. 10 is the wiring diagram for the major part thereof and FIG. 11 is the flow chart for defrosting operation thereof.

In other words, this No. 3 embodiment employs, in addition to the low pressure switch $63L_3$ which detects the completion of the normal pumping-down operation, a low pressure switch $63L_4$ having a pressure setting higher than that of the low pressure switch $63L_3$ and said low pressure switch $63L_4$ is mounted, as shown in FIG. 10, in the on-off control circuit of the compressor motor MC described in No. 1 embodiment.

For the convenience of explanation, said low pressure switch $63L_3$ is called No. 3 low pressure switch in order to distinguish from low pressure switches $63L_1$, $63L_2$, and the low pressure switch $63L_4$ for use in said defrosting operation is called No. 4 low pressure switch.

As stated above, the off-setting pressure of No. 4 low pressure switch $63L_4$ is made higher than that of No. 3 low pressure switch $63L_3$, thereby refrigerant quantity remaining in the defrost circuit being decided. That is, refrigerant quantity corresponding to the pressure difference between the settings of two low pressure switches $63L_4$, $63L_3$ is to remain in the defrost circuit.

Further, the refrigerant piping system of No. 3 embodiment is the system wherein the second stop valve 41 and the bypass passage 28 having a solenoid valve 26 are removed from No. 1 embodiment as shown in FIG. 1 and at the same time, the system wherein the communication passage 42 having the third stop valve 43 is removed from No. 2 embodiment as shown in FIG. 4.

Figure 9:
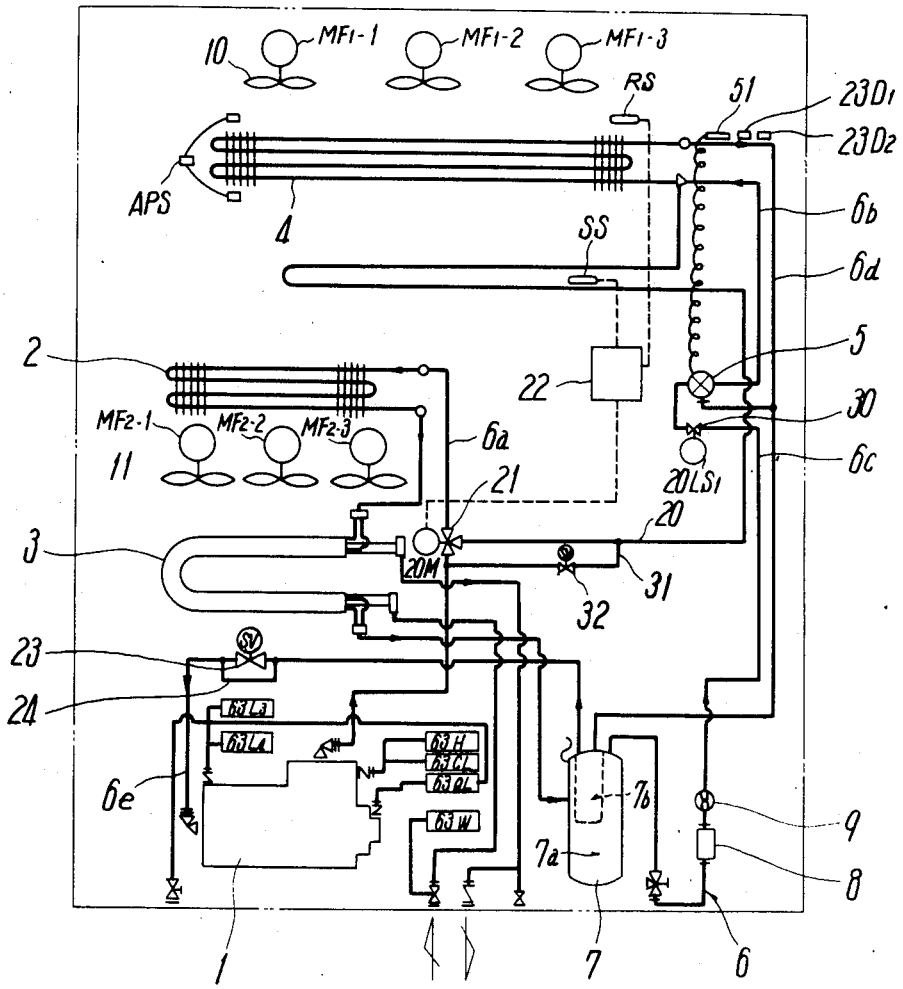
FIG. 9 is the refrigerant piping diagram showing No. 3 embodiment of the refrigeration unit of this invention.

In FIG. 9, those components which are not different from those of No. 1 and No. 2 embodiments are denoted by the same symbols.

Further, the electric circuit for the case where No. 4 low pressure switch $63L_3$ is employed as a means of keeping constant quantity refrigerant in the defrosting circuit utilizing the pumping-down operation is shown in FIG. 10.

In FIG. 10, those components which are same as those in No. 1 embodiment are denoted by the same symbols.

FIG. 10 being basically same with FIG. 2 and the detail having being explained above, only different points will be explained as follows:

(1) As with FIG. 5 and FIG. 8, the solenoid relay $20LS_1$ of said first stop valve 30 is in-series connected with the normallyopen contacts of the auxiliary relay $2X_4$.

(2) The on-off control circuit of the compressor motor MC is constructed so as to consist of an in-series connected safety circuit of a compressor protection thermostat 49, over-current relay OC, a high pressure switch 63H, No. 3 low pressure switch $63L_3$, and an oil pressure protection switch 63QL; an in-parallel connected circuit of the normally-open contacts of the auxiliary relay $2DX_2$, the normally-closed contacts of the defrost relay $2DX_1$ and No. 4 low pressure switch $63L_4$; and the magnet switch 88C of the compressor motor MC.

Figure 11:
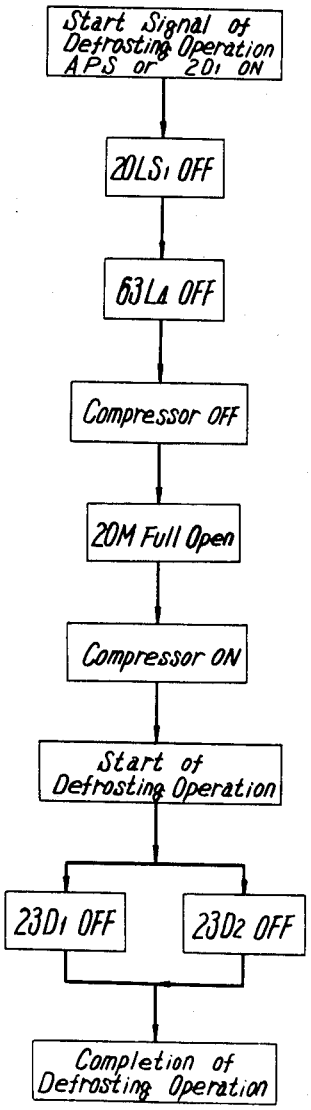
Figure 12:
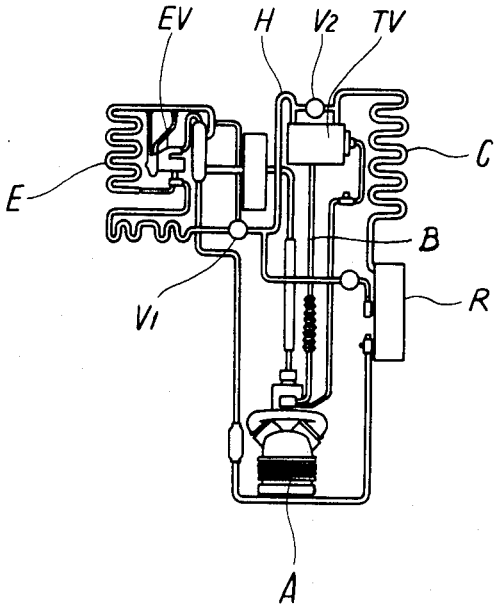
FIG. 12 (PRIOR ART)
FIG. 12 and FIG. 13 are the refrigerant piping diagrams of conventional refrigeration units.
Figure 13:
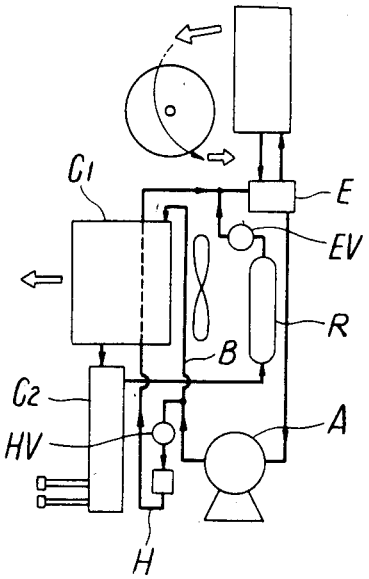
FIG. 13 (PRIOR ART)

In the above constructed No. 3 embodiment, the operation is the same as with No. 1 and No. 2 embodiment. As shown in the flow chart of FIG. 11, said first stop valve 30 is closed by the start signal of defrosting to start the pumping-down operation. In this No. 3 embodiment, the compressor 1 is stopped before the pumping-down operation is completed. After said compressor 1 has been stopped by the action of No. 4 low pressure switch $63L_4$, utilizing the drop of the low side pressure due to refrigerant sealing in the pumping-down operation, said hot gas valve 21 is fully opened.

In other words, when the low side pressure falls below the off-action setting of No. 4 low pressure switch $63L_4$, said low pressure switch goes off and opens the on-off control circuit of the compressor motor MC before the completion of the normal pumping-down operation, that is before the entire refrigerant is sealed in said liquid reservoir and leaving constant quantity refrigerant in the defrost circuit. The magnet switch 88C of said compressor motor MC is thus deenergized, said compressor 1 being stopped, said auxiliary relay $2DX_2$ being energized by the closing of the normally-closed contacts of said magnet switch due to the deenergization thereof, the motorized portion 20M of said hot gas valve 21 operating to fully open said valve 21, said indoor fan motors $MF_{1-1}$,$MF_{1-2}$, $MF_{1-3}$ being simultaneously stopped. At the same time, the normally-open contacts of said auxiliary relay $2DX_2$ which is in parallel connected with No. 4 low pressure switch $63L_4$ is closed by the energization of said auxiliary relay $2DX_2$, said magnet switch 88C being energized to start the compressor 1, the defrosting operation being conducted with constant quantity refrigerant left in the defrost circuit.

In above explained No. 3 embodiment, since the hot gas valve 21 is fully opened after the compressor 1 is stopped by No. 4 low pressure switch 63$L_4$, it is possible to leave constant quantity refrigerant in the defrost circuit.

While the above explained is arranged so as to stop the compressor 1 by the action of No. 4 low pressure switch 63$L_4$ and simultaneously fully open the hot gas valve 21, it is not always necessary to stop the compressor 1. It is also possible to leave constant quantity refrigerant in the defrost circuit by fully opening the hot gas valve 21, while running the compressor 1, by detecting the pressure drop in the pumping-down operation. In this case, the normally-closed contacts of the magnet switch 88C connected with the auxiliary relay 2 $DX_2$ in FIG. 10 has to be replaced by a low pressure switch (similar to the low pressure switch 63$L_4$) which goes on when the low side pressure falls below the setting, and the normally-open contacts of the auxiliary relay 2$DX_2$, the normally-closed contacts of the defrost relay 2$DX_1$ and No. 4 low pressure switch 63$L_4$ which are mounted on the on-off control circuit of said compressor motor have to be removed.

While above explained embodiments relate to a refrigeration unit which is capable of the cold storage operation utilizing hot gas bypass capacity adjustment and the refrigeration operation, they are also applicable to an refrigeration unit performing capacity adjustment by hot gas bypassing. They are also applicable to an refrigeration unit performing the operation by on-off control of the compressor, and in this case, 0 or 100% opening of the hot gas valve 21 is enough for this purpose and 0 - 100% proportional opening control is not necessary.

Further in the above explained embodiments, while the opening control of the hot gas valve 21 are made by detecting the supply air temperature with a supply sensor SS and comparing with the temperature setting, a pressure sensor which detects the high side or low side pressure of refrigerant may be used for this purpose. Said valve opening control may be made by detecting the temperature difference between return and supply air.

Further, while a motorized three-way valve is used as said hot gas valve 21, the combination of two two-way valves may also be used.

Further, while above embodiments relate to a refrigeration unit for marine containers, they are also applicable to a refrigeration unit for the cold storage warehouse.

Further, while an air-cooled condenser 2 and a water-cooled condenser 3 are jointly used in the embodiment, single air-cooled condenser 2 or water-cooled condenser 3 may be used.

Since this invention is constructed so as to have, downstream of condensers 2, 3, a first stop valve 30 which closes at the start signal of the defrosting operation and a constant quantity refrigerant flow-out control mechanism 40 and a constant quantity refrigerant retaining control mechanism these each supplies or retains constant quantity refrigerant in the defrost circuit and to perform the defrosting operation with constant quantity refrigerant, it is possible to perform an optimum defrosting operation irrespective of the operating condition immediately therebefore.

In other words, since the defrosting operation is conducted with constant quantity refrigerant optimum for the operation, no abnormal rise in the refrigerant high side pressure or over-current in the compressor motor MC which cause the operation failure will take place in the refrigeration or cold storage operation after the completion of said defrosting operation. At the same time, it is possible to solve the problem of a long defrosting time due to too small refrigerant for the defrosting operation.

Further, since the defrosting operation is conducted with optimum quantity rrfrigerant and no excess refrigerant is circulated, it is possible to save the compressor input that much without the waste of electric energy in the defrosting operation.

While several embodiments of the invention have been shown and described, the invention is not limited to the specific constructions thereof, which are merely exemplified in the specification rather than defined.

What is claimed is:

1. A refrigeration unit operable in a cooling mode and a defrost mode, comprising:

a compressor, an evaporator, a cooling circuit including a condenser, said cooling circuit for supplying hot gas discharged from said compressor to said condenser through a discharged gas line and returning said hot gas through said evaporator to said compressor, said cooling circuit comprising a liquid reservoir portion at a portion thereof which includes said condenser a hot gas by-pass passage for supplying hot gas discharged from said compressor to said evaporator by-passing said condenser, a hot gas valve means for controlling opening and closing of said hot gas by-pass passage and for controlling opening and closing of said discharged gas line, a hot gas valve control means for causing, responsive to initiation of a pumping down operation, said hot gas valve means to close said hot gas by-pass passage and to open said discharged gas line and for causing, responsive to completion of said pumping down operation, said hot gas valve means to open said hot gas by-pass passage and to close said discharged gas line, a defrost circuit for supplying hot gas through said hot gas valve means to said evaporator and for returning said hot gas to said compressor, a constant quantity refrigerant flow-out means including a first stop valve mounted in said cooling circuit downstream of said condenser, means for closing said first stop valve, responsive to completion of a said cooling mode, to enable said pumping down operation to begin such that refrigerant is sealed in said liquid reservoir portion, said constant quantity refrigerant flow-out means for supplying a predetermined constant amount of refrigerant from said liquid reservoir portion to said defrost circuit, responsive to completion of said pumping down operation, whereby a defrosting operation is performed with said predetermined constant amount of refrigerant being supplied to the defrost circuit, said constant quantity refrigerant flow-out control mechanism further including a communication passage which by-passes said first stop valve and allows the liquid reservoir portion of the cooling circuit for sealing refrigerant in the pumping-down operation to communicate with a low pressure side of the compressor, and a second stop valve which is mounted in said communication passage and supplies a predetermined constant amount of refrigerant only into said defrost circuit out of an entire amount of refrigerant sealed in said liquid reservoir.

2. A refrigeration unit as in claim 1, wherein a means for on-off control of said second stop valve is provided to open said second stop valve afer completion of the pumping-down operation and to close said second stop valve after flow-out of constant quantity refrigerant into the defrost circuit.

3. A refrigeration unit as in claim 2, wherein said means for on-off control comprises a low pressure switch.

4. A refrigeration unit as in claim 3, wherein said low pressure switch closes said second stop valve responsive to low side pressure falling below a pressure setting of said low pressure switch and opens said second stop valve responsive to low side pressure rising above said pressure setting.

5. A refrigeration unit as in claim 2, wherein said means for on-off control comprises a timer means.

* * * * *